US008727008B2

(12) United States Patent
Krpec

(10) Patent No.: US 8,727,008 B2
(45) Date of Patent: May 20, 2014

(54) TOOL FOR REMOVING DEBRIS FROM A WELLBORE

(76) Inventor: Mark Wayne Krpec, Fulshear, TX (US)

( * ) Notice: Subject to any disclaimer, the term of this patent is extended or adjusted under 35 U.S.C. 154(b) by 474 days.

(21) Appl. No.: 13/086,515

(22) Filed: Apr. 14, 2011

(65) Prior Publication Data

US 2011/0253376 A1 Oct. 20, 2011

Related U.S. Application Data

(60) Provisional application No. 61/324,724, filed on Apr. 15, 2010.

(51) Int. Cl.
*E21B 21/00* (2006.01)

(52) U.S. Cl.
USPC ..... 166/311; 166/99; 166/332.2

(58) Field of Classification Search
USPC ..... 166/318, 332.2, 334.2, 311, 99, 175
See application file for complete search history.

(56) References Cited

U.S. PATENT DOCUMENTS

| | | | | |
|---|---|---|---|---|
| 5,251,701 | A | 10/1993 | Williams et al. | |
| 6,220,370 | B1 | 4/2001 | Wesson et al. | |
| 2008/0236835 | A1 | 10/2008 | Rayssiguier et al. | |
| 2008/0236841 | A1 * | 10/2008 | Howlett et al. | 166/381 |

FOREIGN PATENT DOCUMENTS

| | | |
|---|---|---|
| WO | WO-2009-116874 | 9/2009 |

OTHER PUBLICATIONS

International Search Report and Written Opinion dated Oct. 27, 2011 for International Application No. PCT/US2011/032514.

* cited by examiner

*Primary Examiner* — Yong-Suk (Philip) Ro
(74) *Attorney, Agent, or Firm* — Patterson & Sheridan, LLP

(57) ABSTRACT

An assembly for removing debris and/or conducting a wellbore operation may include a mandrel, a sliding sleeve rotationally coupled to the mandrel, and a flushing sleeve coupled to the sliding sleeve. A releasable connection may temporarily prevent axial movement between the sliding sleeve and the mandrel. A downhole tool may be coupled to the mandrel to conduct the wellbore operation. The flushing sleeve may be hydraulically actuated to an extended position ahead of the downhole tool. A method of removing debris from a wellbore and conducting a wellbore operation may include lowering an assembly into the wellbore, supplying pressurized fluid into the wellbore using the assembly to remove debris from the wellbore, and moving a downhole tool to a position where at least a portion of the downhole tool is disposed outside of the assembly to conduct the wellbore operation.

24 Claims, 4 Drawing Sheets

TOOL FOR REMOVING DEBRIS FROM A WELLBORE

CROSS-REFERENCE TO RELATED APPLICATIONS

This application claims benefit of U.S. Provisional Patent Application Ser. No. 61/324,724, filed Apr. 15, 2010, which is herein incorporated by reference in its entirety.

BACKGROUND OF THE INVENTION

1. Field of the Invention

Embodiments of the invention generally relate to an assembly having a "washover" tool for clearing debris from a wellbore, and a downhole tool for performing a wellbore operation in a single trip into the wellbore. Particularly, embodiments of the invention relate to removing debris from a wellbore to provide uninhibited access to a wellbore device located in the wellbore to conduct a wellbore operation.

2. Description of the Related Art

There are a variety of wellbore devices used to facilitate the drilling, completion, and production of a wellbore. One such device is a packer or a plug, which can be used to seal a portion of the wellbore as needed. It is often desired to retrieve these wellbore devices from the wellbore after use. A "fishing" operation utilizes a retrieval tool that is lowered into the wellbore to engage and retrieve the wellbore device. However, often times there is a significant amount of debris, including dirt, rock fragments, and other materials located on top of the wellbore device that obstructs the retrieval tool from engagement with the wellbore device. An additional, separate wellbore operation may be required to remove the debris, which adds time and cost to the overall retrieval operation.

Therefore, there is a need for an assembly and method of use that can effectively remove debris from a wellbore, while not inhibiting performance of another wellbore operation.

SUMMARY OF THE INVENTION

In one embodiment, an assembly for removing debris from a wellbore and/or conducting a wellbore operation may include a mandrel, a sliding sleeve rotationally coupled to the mandrel, and a flushing sleeve coupled to the sliding sleeve. The flushing sleeve may be used to "flush" debris from the wellbore. A releasable connection may be used to temporarily prevent axial movement between the sliding sleeve and the mandrel. A downhole tool may be coupled to the mandrel to conduct the wellbore operation.

In one embodiment, a method of removing debris from a wellbore and/or conducting a wellbore operation may include lowering an assembly into the wellbore, wherein the assembly includes a mandrel, a sleeve coupled to the mandrel, and a downhole tool coupled to the mandrel and positioned within the sleeve. The method may include supplying pressurized fluid into the wellbore using the sleeve to remove debris from the wellbore. The method may further include moving the downhole tool to a position where at least a portion of the downhole tool is disposed outside of a bore of the sleeve and conducting the wellbore operation using the downhole tool.

In one embodiment, an assembly for removing debris from a wellbore and conducting a wellbore operation may comprise a mandrel having a downhole tool coupled to an end of the mandrel; a piston member coupled to the mandrel and forming a piston chamber that is in fluid communication with a bore of the mandrel via one or more ports disposed through the mandrel; and a flushing sleeve coupled to the piston member. Pressurization of the piston chamber moves the piston member and the flushing sleeve relative to the downhole tool.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
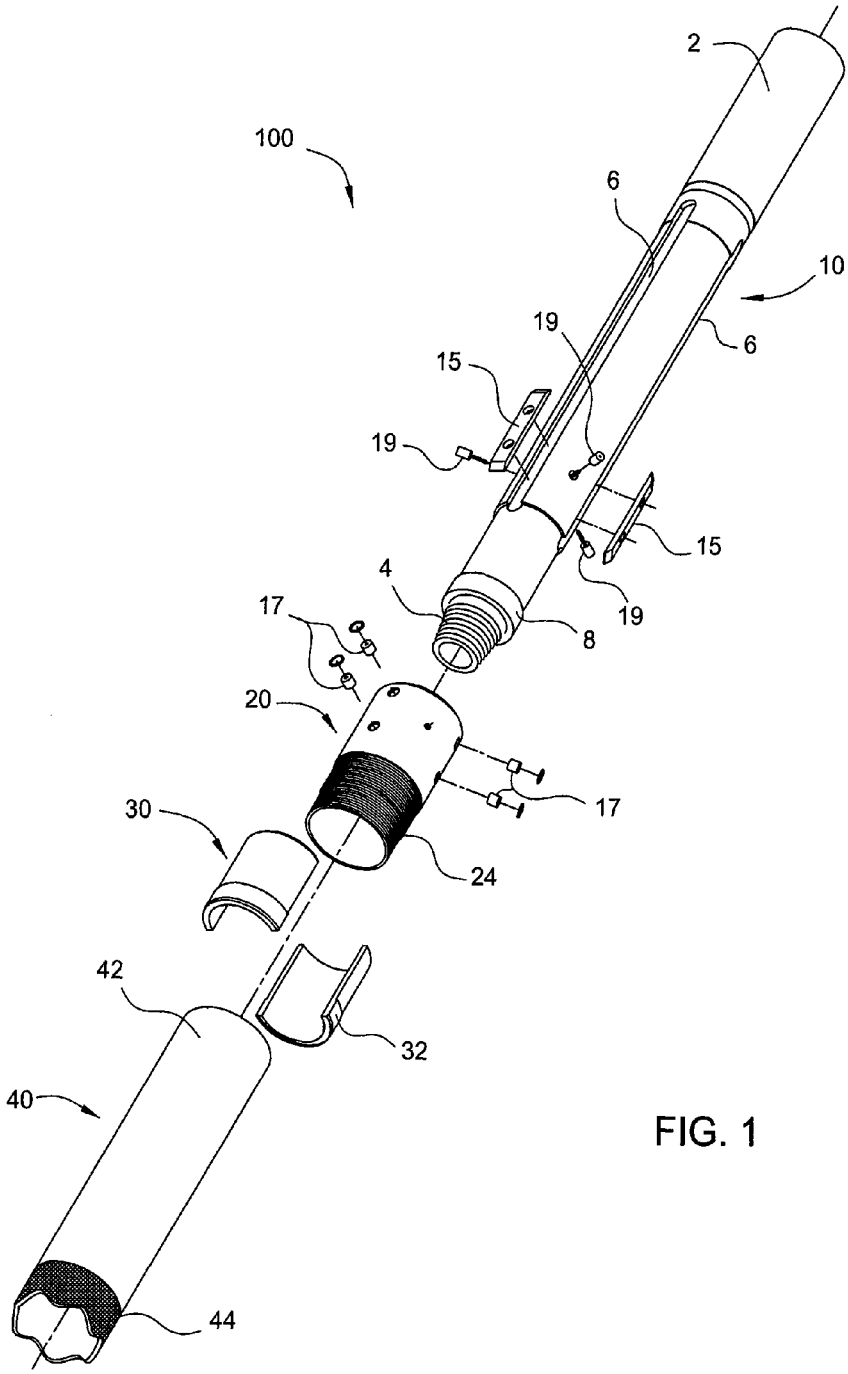
FIG. 1 illustrates a tool for removing debris from a wellbore according to one embodiment.

FIG. 1 illustrates a tool 100 for removing debris from a wellbore according to one embodiment. The tool 100 includes a mandrel 10, a sliding sleeve 20, a bushing 30, and a flushing sleeve 40. An upper end 2 of the mandrel 10 may be configured for connection to a workstring, and a lower end 4 may be configured for connection to a downhole tool 50 (shown in FIGS. 2 and 4). One or more shear pins 19 may be used to temporarily prevent axial movement between the mandrel 10 and the sliding sleeve 20, which supports the flushing sleeve 40. The tool 100 may be used to clear debris from the wellbore by flowing fluid through the flushing sleeve 40, while protecting the downhole tool 50 from contact with the debris. During or after removal of the debris, the shear pins 19 may be sheared to move the flushing sleeve 40 to a position that does not obstruct the use of the downhole tool 50 to conduct a wellbore operation.

In one embodiment, the mandrel 10, the sliding sleeve 20, the bushing 30, and the flushing sleeve 40 may each be formed from a metallic tubular member having a bore disposed therethrough. The mandrel 10 may include one or more slots 6 configured to receive one or more sliding keys 15. The sliding sleeve 20 may be connected to the mandrel 10 via one or more locking pins 17, which also extend through the sliding keys 15 and engage the slots 6. In this manner, the sliding sleeve 20 may be axially movable relative to the mandrel 10, but is rotationally coupled thereto. A lower end 24 of the sliding sleeve 20 may be connected to an upper end 42 of the flushing sleeve 40, via a threaded connection for example. In one embodiment, the sliding sleeve 20 may be integral with the flushing sleeve 40, such that they form a unitary sleeve member. A lower end 42 of the flushing sleeve 40 may include one or more teeth and/or an abrasive outer surface, such as a carbide coating, to facilitate debris removal from the wellbore. The bushing 30 may include a split-bearing member, and may be disposed between the mandrel 10 and the flushing sleeve 40, such that a shoulder 32 of the bushing 30 abuts a shoulder 8 of the mandrel 10. The shoulder 32 of the bushing 30 may also be used to retain the sliding sleeve 20 and thus the flushing sleeve 40 from removal with the mandrel 10. An inner surface of the flushing sleeve 40 may slide along an outer surface of the bushing 32 to space the flushing sleeve 40 from interference with the downhole tool 50. The shear pins 19 may extend through the sliding sleeve 20 and the mandrel 10 to temporarily secure relative movement therebetween. Other releasable-type connections may be used in place of or with the shear pins 19.

Figure 2:
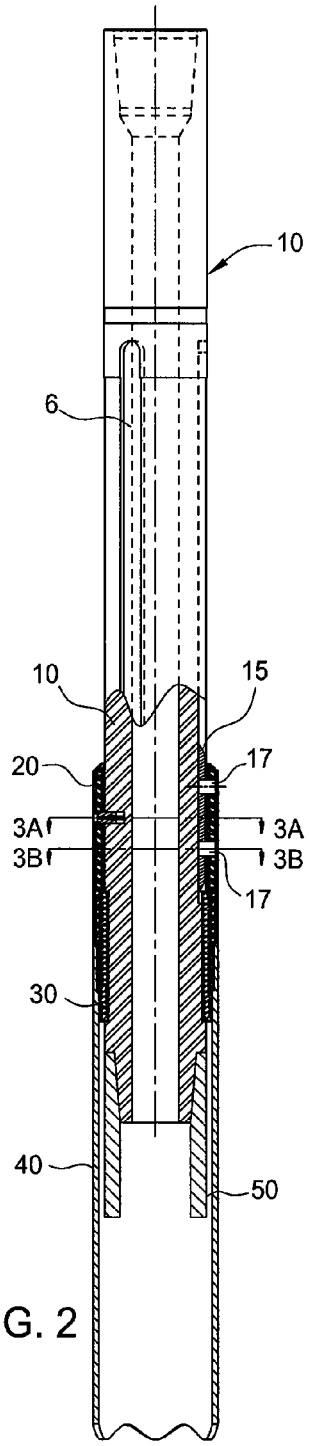
FIG. 2 illustrates a sectional view of the tool in a first position according to one embodiment.
Figure 3A:
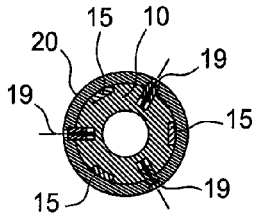
FIG. 3A illustrates cross-section 3A-3A of FIG. 2.
Figure 3B:
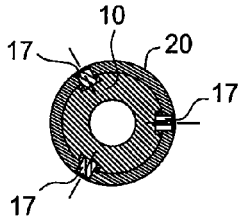
FIG. 3B illustrates cross-section 3B-3B of FIG. 2.

FIG. 2 illustrates the tool 100 in a first position, wherein the sliding sleeve 20 and the flushing sleeve 40 are fixed to the mandrel 10 via the shear pins 19 in a manner that the downhole tool 50 is disposed in the bore of the flushing sleeve 20. FIG. 3A illustrates cross-section A-A of FIG. 2, and FIG. 3B illustrates cross-section B-B of FIG. 2. As illustrated in FIG. 3A, three shear pins 19 are provided through the sliding sleeve 20 and the mandrel 10, and three sliding keys 15 are located in three slots 6 disposed in the outer surface of the mandrel 10. As illustrated in FIG. 3B, three locking pins 17 extend through the sliding sleeve 20, the sliding keys 15, and into the slots 6 of the mandrel 10.

As the tool 100 is lowered into a wellbore and/or upon encountering a wellbore device located therein, pressurized fluid may be supplied to the tool 100 via a workstring, such as a coiled tubing string or jointed tubular string, which is connected to the upper end 2 of the mandrel 10. The pressurized fluid may flow through the bores of the mandrel 10, the downhole tool 50, and the flushing sleeve 40, and into the wellbore to flush any debris from below the tool 100 before substantial interference and/or contact with the downhole tool 50. The pressurized fluid and the flushed debris may be forced up the annulus between the outer surface of the tool 100 and the wellbore for removal.

As the tool 100 is lowered into the wellbore and/or upon encountering the wellbore device, the tool 100 may be rotated to "break-up" any debris that is lodged in the wellbore to facilitate ease of removal with the pressurized fluid flow. Torque applied to the mandrel 10 via the workstring may be transferred to the sliding sleeve 20 via the locking pins 17, the sliding keys 15, and/or the shear pins 19. In one embodiment, the workstring may be rotated at the surface of the wellbore and/or a mud motor (as known in the art) may be used to facilitate rotation of the mandrel 10 downhole via pressurized fluid flow. Rotation of the sliding sleeve 20 rotates the flushing sleeve 40. The teeth and/or the abrasive outer surface of the flushing sleeve 40 may be used to remove any wellbore debris before substantial interference and/or contact with the downhole tool 50. In one embodiment, the flushing sleeve 40 may be positioned over at least a portion of the wellbore device that is secured in the wellbore. For example, the tool 100 may be lowered into the wellbore so that at least a portion of the wellbore device is located in the bore of the flushing sleeve 40, while the flushing sleeve 40 is being rotated and/or pressurized fluid is being supplied through the bore of the flushing sleeve 40 to remove any debris surrounding the periphery of the wellbore device. In one embodiment, the tool 100 may be configured so that at least a portion of the wellbore device may be located in the bore of the flushing sleeve 40 without substantial interference and/or contact with the downhole tool 50 prior to release of the shear pins 19.

Figure 4:
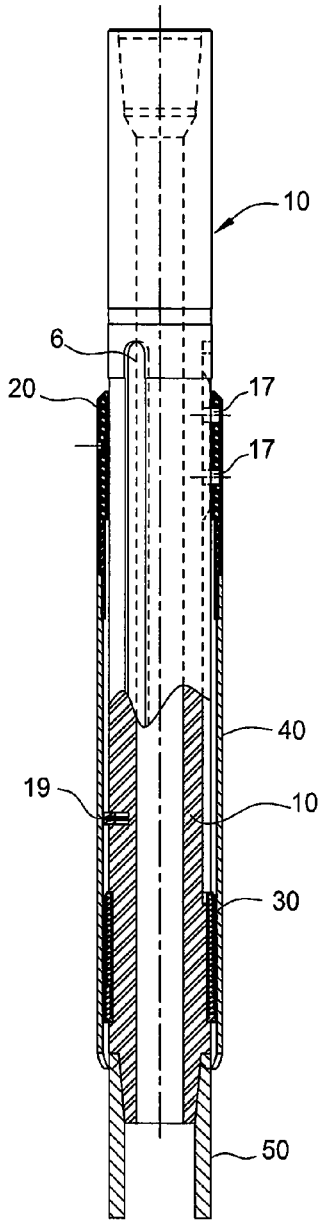
FIG. 4 illustrates a sectional view of the tool in a second position according to one embodiment.

FIG. 4 illustrates the tool 100 in a second position, subsequent to shearing of the shear pins 19, thereby enabling axial movement of the sliding sleeve 20 and the flushing sleeve 40 relative to the mandrel 10, wherein the downhole tool 50 is moved from the bore of the flushing sleeve 40. The lower end of the tool 100, in particular the lower end 42 of the flushing sleeve 40, may be positioned against the wellbore device secured in the wellbore to provide a reaction surface. The weight of the workstring and/or the mandrel 10 may be set down on the shear pins 19 through the use of gravity and/or forced from the wellbore surface. In one embodiment, a force may be applied to the workstring from the wellbore surface to shear the shear pins 19, for example when the tool 100 is located in a horizontal section of a wellbore. A reaction force is applied to the shear pins 19 by the sliding sleeve 20 via the flushing sleeve 40 and wellbore device. Shearing of the shear pins 19 enables the sliding sleeve 20 and the flushing sleeve 40 to move relative to the mandrel 10 and thus the downhole tool 50. The sliding sleeve 20 is guided along the axial length of the slots 6 by the sliding keys 15 and the locking pins 17. The sliding sleeve 20 may also include an abrasive outer surface to aid/prevent the tool 100 from "sticking" in the wellbore. The slots 6 may be configured to limit the amount of axial movement between the mandrel 10 and the sliding sleeve 20 and therefore the flushing sleeve 40. Continued movement of the mandrel 10 may move the downhole tool 50 out of the flushing sleeve 40 bore to conduct a wellbore operation without interference from the flushing sleeve 40. In one embodiment, pressurized fluid may move the sliding sleeve 20 and/or the flushing sleeve 40 relative to the downhole tool 50 to prevent interference with the wellbore operation.

In one embodiment, the downhole tool 50 may be used to conduct a wellbore retrieval operation. In one embodiment, the downhole tool 50 may include a retrieval tool operable to retrieve a wellbore device including a packer or plug from a wellbore. In one embodiment, the tool 100 may be used to remove debris located above a packer/plug secured in a wellbore, so that the downhole tool 50 can retrieve the packer/plug without obstruction from the debris and the tool 100.

Figure 5B:
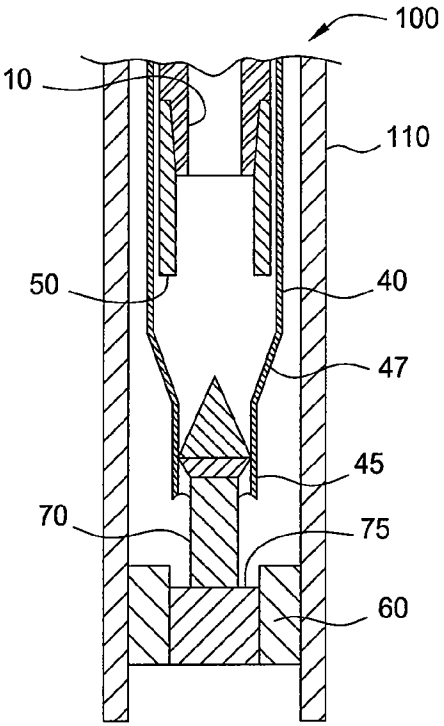
FIGS. 5A and 5B illustrate embodiments of a flushing sleeve of the tool engaging a packer and a packer plug.
Figure 5A:
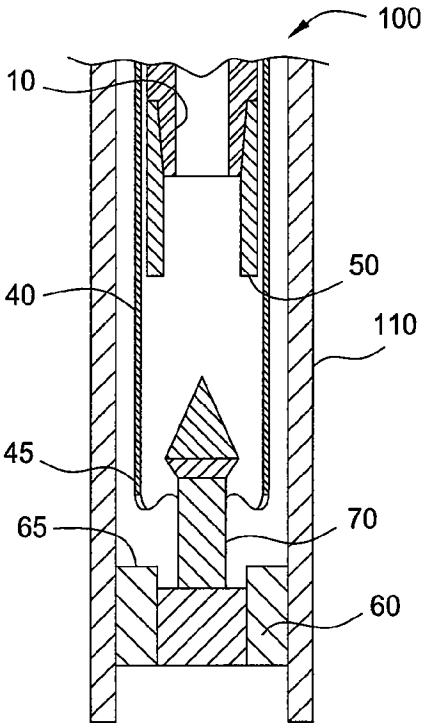

FIGS. 5A and 5B illustrate the flushing sleeve 40 just prior to engaging a packer 60 and a packer plug 70, respectively, downhole in a wellbore 110. Depending on the size and/or style of packer 60 and packer plug 70, the tool 100 can be modified to engage the packer 60 and/or the packer plug 70. As illustrated in FIG. 5A, the lower end 45 of the flushing sleeve 40 is dimensioned so that it lands on and engages the upper end 65 of the packer 60. The upper end 65 of the packer 60 may be used as a reaction surface against which the tool 100 can be forced to shear the shear pins 19 and allow the downhole tool 50 to engage the packer 60 and/or the packer plug 70 for retrieval. As illustrated in FIG. 5B, the lower end 45 of the flushing sleeve 40 has a tapered portion 47 so that the lower end 45 is dimensioned to land on and engage the upper end 75 of the packer plug 70. The upper end 75 of the packer plug 70 may be used as a reaction surface against which the tool 100 can be forced to shear the shear pins 19 and allow the downhole tool 50 to engage the packer plug 70 and/or the packer 60 for retrieval. The lower end 45 of the flushing sleeve 40 may be a removable portion that is coupled to the remaining portion of the flushing sleeve 40 so that the tool 100 can be modified to retrieve various sizes and styles of packers and/or packer plugs.

Figure 6A:
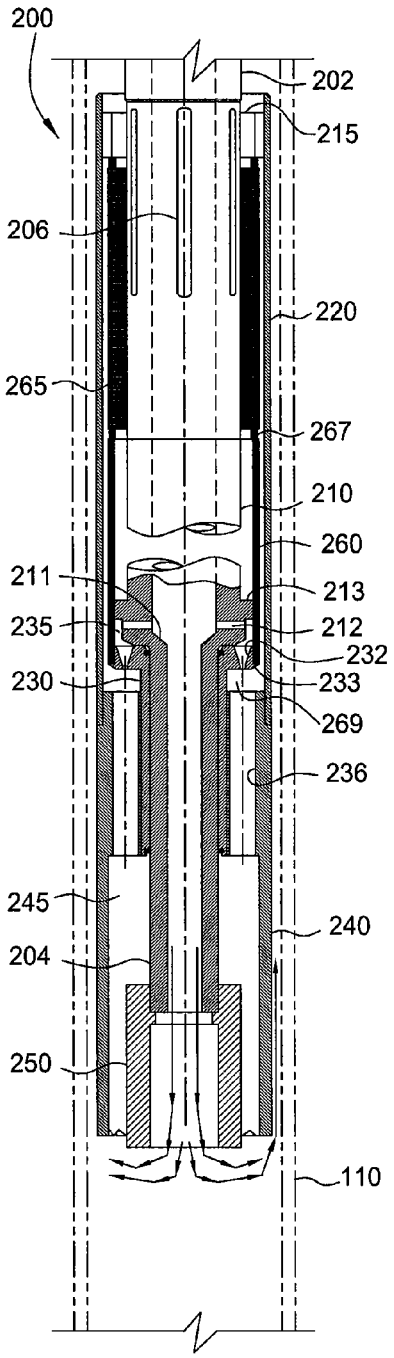
FIGS. 6A and 6B illustrate a sectional view of the tool in a first position and a second position according to another embodiment.
Figure 6B:
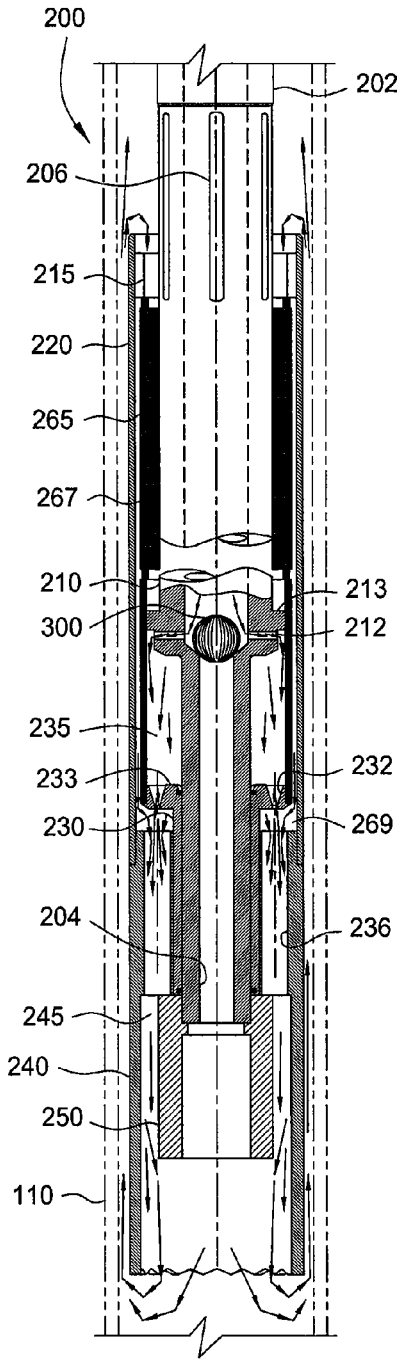

FIGS. 6A and 6B illustrate a tool 200 for removing debris from a wellbore 110 according to another embodiment. The tool 200 includes a mandrel 210, a drive collar 215, a sliding sleeve 220, a piston member 230, and a flushing sleeve 240. An upper end 202 of the mandrel 210 may be configured for connection to a workstring, and a lower end 204 may be configured for connection to a downhole tool 250. The tool 200 may be used to clear debris from the wellbore by flowing fluid through a bore of the mandrel 210 and/or the flushing sleeve 240, while protecting the downhole tool 250 from contact with the debris, as illustrated in FIG. 6B. During run-in and/or after removal of the debris, the flushing sleeve 240 may be moved to a position that does not obstruct the use of the downhole tool 250, as illustrated in FIG. 6A, to conduct a wellbore operation.

In one embodiment, the mandrel 210, the sliding sleeve 220, the piston member 230, and the flushing sleeve 240 may each be formed from a metallic tubular member having a bore disposed therethrough. The mandrel 210 may include one or more slots 206 for engagement with one or more corresponding keys formed on the inner surface the drive collar 215, which couples the sliding sleeve 220 to the mandrel 210. In this manner, the sliding sleeve 220 may be axially movable relative to the mandrel 210, but is rotationally coupled thereto. A lower end of the sliding sleeve 220 may be connected to an upper end of the flushing sleeve 240, via a threaded connection for example. In one embodiment, the sliding sleeve 220 may be integral with the flushing sleeve 240, such that they form a unitary sleeve member. A lower end of the flushing sleeve 240 may include one or more teeth and/or an abrasive outer surface, such as a carbide coating, to facilitate debris removal from the wellbore.

The mandrel 210 may include a seat 211 for receiving a plug or ball member 300, as illustrated in FIG. 6B, to close fluid communication through the tapered lower end 204 of the mandrel 210 and direct fluid through one or more ports 212 disposed through the wall of the mandrel 210, above the seat 211. The ports 212 are in fluid communication with one or more ports 232 disposed through a shoulder portion 233 of the piston member 230 that forms a piston chamber 235 with the mandrel 210 and a sleeve member 260. The piston member 230 may be sealingly and slideably coupled to the lower end 204 of the mandrel 210. The sleeve member 260 is coupled to the shoulder portion 233 of the piston member 230, and may slideably and sealingly engage a shoulder portion 213 of the mandrel 210. The sleeve member 260 is also coupled to the drive collar 215 and includes a screen portion 265 disposed above the shoulder portion 213 of the mandrel 210.

An annulus 267 is formed between the outer surface of the sleeve member 260 and the inner surface of the sliding sleeve 220 through which fluid may flow. The annulus 267 is in communication with a flow chamber 269 that is formed below the shoulder portion 233 of the piston member 230. The flow chamber 269 is also in communication with the piston chamber 235 via the ports 232. One or more flow channels 236 are formed between the piston member 230 and the flushing sleeve 240 to direct fluid from the flow chamber 269 to an equalization chamber 245 that is formed within the flushing sleeve 240. Fluid may flow through the equalization chamber 245, around the downhole tool 250, and out the lower end of the flushing sleeve 240 into the wellbore.

During run-in of the tool 200 into the wellbore 110, the sliding sleeve 220 and/or the flushing sleeve 240 may initially be axially fixed to the mandrel 210 using a shearable connection, such as shear screws 19 described above with respect to FIGS. 2-4. The tool 200 may be run into the wellbore 110 so that the lower ends of the flushing sleeve 240 and the downhole tool 250 are substantially flush or adjacent to each other as illustrated in FIG. 6A. Fluid may be supplied through the bore of the mandrel 210 and the downhole tool 250 into the wellbore 110 during run-in and circulated back to the surface of the wellbore 110.

The tool 200 is hydraulically actuated to extend the flushing sleeve 240 ahead of the downhole tool 250 to protect the downhole tool 250 from contact with wellbore debris, while generating a fluid flow sufficient to flush the debris from the wellbore. When the tool 200 is located at the desired position within the wellbore 110, the ball member 300 is dropped through the bore of the mandrel 210 so that it lands on the seat 211. The ball member 300 ball seals against the seat 211 and closes fluid communication through the lower end 204 of the mandrel 210. Further fluid flow is diverted though the ports 212 into the piston chamber 235 and out through the ports 232. At a pre-determined fluid rate, and based on fluid characteristics and orifice size of the ports 212 and/or the ports 232, a pressure is generated in the piston chamber 235 to force the piston member 230 to release or shear any shearable connection between the mandrel 210 and the sliding sleeve 220 and/or the flushing sleeve 240 to allow relative axial movement between the mandrel 210 and the sliding sleeve 220 and flushing sleeve 240.

The pressurized fluid flow from the ports 232 is directed to the flow chamber 269, through the flow channels 236, through the equalization chamber 245, and out through the end of the flushing sleeve 240 to clear any debris within the wellbore. The fluid flow is circulated back to the surface of the wellbore 110, and may also enter through the upper end of the sliding sleeve 220. Any fluid that flows through the upper end of the sliding sleeve 220 may flow past the drive collar 215 and through the screen portion 265 to clear any debris in the fluid that flows into the annulus 267. The fluid flow through the annulus 267 may combine with the fluid flow from the piston chamber 235 in the flow chamber 269.

The large volume of fluid flow in the flow chamber 269 is directed through the flow channels 236 into the equalization chamber 245, which has a larger flow area as compared to the flow channels 236 and the flow chamber 269, which results in a pressure drop or reduction. The pressurized piston chamber 235 can therefore force the piston member 230, the sleeve member 260, the drive collar 215, the sliding sleeve 220, and the flushing sleeve 240 away from the shoulder portion 213 of the mandrel 210. The stroke of the flushing sleeve 240 may be limited by the travel of the drive collar 215 within the slots 206 or by contact of the flow channels 236 and/or piston member 230 on the upper end of the downhole tool 250. In this manner, the flushing sleeve 240 is moved to a position at least partially below the downhole tool 250 to flush and remove debris from the wellbore 110 without interference with the downhole tool 250.

After the wellbore debris is removed, fluid flow through the mandrel may be stopped and the tool 200 may be lowered to conduct a wellbore operation, such as retrieval of a packer and/or packer plug. The tool 200 may be lowered until the flushing sleeve 240 engages an upper end of the packer and/or packer plug, which will retract the flushing sleeve 240 relative to the mandrel 210 and the downhole tool 250. Further lowering of the tool 200 allows the mandrel 210 and the downhole tool 250 to move downward relative to the flushing sleeve 240 so that the downhole tool 250 can be moved to a position, such as partially outside of the bore of the flushing sleeve 240 as illustrated in FIG. 6A, to conduct the wellbore operation without interference with the flushing sleeve 240.

At any time during the debris removal operation, if the tool 200 is lowered too rapidly such that the lower end of the flushing sleeve 240 is plugged off, the pressure in the equalization chamber 245 may increase and/or equalize with the pressure in the flow chamber 269 and the piston chamber 230. The equalization of pressure and the reduced fluid flow through the ports 212, 232 may cause the downward force on the piston member 230 and thus the flushing sleeve 240 to approach zero. As a result, the flushing sleeve 240 can be retracted clear of the debris to prevent the plugging and permit continued removal of the debris. This "self-regulating" feature enhances rapid flushing and removal of stubborn debris.

By reducing fluid flow rate, the hydraulic force on the piston member 230 can be removed. With no hydraulic force on the piston member 230, the positions of the flushing sleeve 240 and the downhole 250 can be determined by measuring the weight or load of the tool 200 at different elevations. For example, the weight of the flushing sleeve 240 and the sliding sleeve 220 are transferred to the wellbore packer and/or packer plug when in contact. The change in the load on the tool 200 may provide an indication at the surface of the wellbore regarding the position of the tool 200 relative to the packer and/or packer plug. In one embodiment, the lower end 204 of the mandrel 210 may include one or more ports that are in fluid communication with the piston chamber 235 and/or the equalization chamber 245 when the piston member 230 is at full stroke, to thereby indicate the position of the piston member 230, the sliding sleeve 220, and/or the flushing sleeve 240.

While the foregoing is directed to embodiments of the invention, other and further embodiments of the invention may be devised without departing from the basic scope thereof, and the scope thereof is determined by the claims that follow.

The invention claimed is:

1. An assembly for removing debris from a wellbore and conducting a wellbore operation, comprising:

a mandrel;

a sliding sleeve rotationally coupled to the mandrel;

a flushing sleeve coupled to the sliding sleeve, wherein a releasable connection temporarily prevents axial movement between the sliding sleeve and the mandrel; and a downhole tool coupled to the mandrel wherein the releasable connection secures the sliding sleeve to the mandrel so that the downhole tool is disposed in a bore of the flushing sleeve and the flushing sleeve is moveable with respect to the mandrel.

2. The assembly of claim 1, wherein upon the release of the releasable connection, the downhole tool is movable to a position where at least a portion of the downhole tool is disposed outside of the bore of the flushing sleeve.

3. The assembly of claim 2, wherein the mandrel has a bore in communication with a bore of the downhole tool and the bore of the flushing sleeve to direct pressurized fluid into the wellbore.

4. The assembly of claim 3, wherein the sliding sleeve is rotationally coupled to the mandrel by a locking pin disposed through the sliding sleeve and extending into a slot of the mandrel.

5. The assembly of claim 4, further comprising a sliding key disposed in the slot, wherein the locking pin extends through the sliding key.

6. The assembly of claim 5, further comprising a bushing disposed between the mandrel and the flushing sleeve.

7. The assembly of claim 1, wherein the flushing sleeve includes at least one of one or more teeth and an abrasive outer surface for removing debris from the wellbore.

8. The assembly of claim 1, wherein the downhole tool is a retrieval tool configured to retrieve a wellbore device from the wellbore, wherein the wellbore device includes at least one of a packer and a plug.

9. The assembly of claim 8, wherein the wellbore device includes an extension thereon; and the downhole tool is receivable over, and securable to, the extension.

10. The assembly of claim 1, wherein the downhole tool is positionable, with respect to the flushing sleeve, at least at a first position and a second position, and upon releasing of the releasable connection, the flushing sleeve is movable from the second position to the first position wherein at least a portion of the downhole tool is disposed within the bore of the flushing sleeve.

11. The assembly of claim 1, wherein the downhole tool is positionable, with respect to the flushing sleeve, at least at a first position and a second position, and upon releasing of the releasable connection, the flushing sleeve is movable from the first position to the second position wherein at least a portion of the downhole tool extends from the bore of the flushing sleeve.

12. The assembly of claim 1, wherein the downhole tool is positionally fixed with respect to the mandrel.

13. An assembly for removing debris from a wellbore and conducting a wellbore operation, comprising:

a mandrel;

a sliding sleeve rotationally coupled to the mandrel;

a flushing sleeve, having an open end, coupled to the sliding sleeve to enable movement of the flushing sleeve during axial movement of the sliding sleeve with respect to the mandrel, wherein a releasable connection temporarily prevents axial movement between the sliding sleeve and the mandrel; and a downhole tool coupled to the mandrel, wherein the flushing sleeve and the downhole tool are moveable with respect to one another.

14. The assembly for removing debris from a wellbore and conducting a wellbore operation of claim 13, wherein the mandrel, the sliding sleeve and the downhole tool further include interconnected fluid flow paths extending therethrough.

15. The assembly for removing debris from a wellbore and conducting a wellbore operation of claim 14, wherein the mandrel includes at least two fluid flow paths therethrough and a ball seat, and one of the flow paths extends through the ball seat.

16. The assembly for removing debris from a wellbore and conducting a wellbore operation of claim 15, wherein the sliding sleeve includes a piston interposed between a flow passage of the mandrel other than the flow passage extending through the ball seat, and the downhole tool.

17. The assembly for removing debris from a wellbore and conducting a wellbore operation of claim 13, wherein the mandrel and the sliding sleeve are interconnected by shearable connectors.

18. An assembly for removing debris from a wellbore and conducting a wellbore operation, comprising:

a mandrel;

a sliding sleeve rotationally coupled to the mandrel;

a flushing sleeve coupled to the sliding sleeve, wherein a releasable connection temporarily prevents axial movement between the sliding sleeve and the mandrel; and a downhole tool coupled to the mandrel wherein the releasable connection secures the sliding sleeve to the mandrel so that the downhole tool is disposed in a bore of the flushing sleeve and the flushing sleeve is moveable with respect to the mandrel, wherein upon the release of the releasable connection, the downhole tool is movable to a position where at least a portion of the downhole tool is disposed outside of the bore of the flushing sleeve.

19. The assembly of claim 18, wherein the mandrel has a bore in communication with a bore of the downhole tool and the bore of the flushing sleeve to direct pressurized fluid into the wellbore.

20. The assembly of claim 19, wherein the sliding sleeve is rotationally coupled to the mandrel by a locking pin disposed through the sliding sleeve and extending into a slot of the mandrel.

21. The assembly of claim 20, further comprising a sliding key disposed in the slot, wherein the locking pin extends through the sliding key.

22. The assembly of claim 21, further comprising a bushing disposed between the mandrel and the flushing sleeve.

23. The assembly of claim 18, wherein the flushing sleeve includes at least one of one or more teeth and an abrasive outer surface for removing debris from the wellbore.

24. The assembly of claim 18, wherein the downhole tool is a retrieval tool configured to retrieve a wellbore device from the wellbore, wherein the wellbore device includes at least one of a packer and a plug.

* * * * *